US010487536B1

(12) United States Patent
Botello et al.

(10) Patent No.: US 10,487,536 B1
(45) Date of Patent: Nov. 26, 2019

(54) STAKE PULLING APPARATUS AND METHOD OF USE

(71) Applicants: Eleazar G. Botello, Houston, TX (US); Eden A. Botello, Houston, TX (US); Jose R. Botello, Houston, TX (US)

(72) Inventors: Eleazar G. Botello, Houston, TX (US); Eden A. Botello, Houston, TX (US); Jose R. Botello, Houston, TX (US)

( * ) Notice: Subject to any disclaimer, the term of this patent is extended or adjusted under 35 U.S.C. 154(b) by 0 days.

(21) Appl. No.: 16/352,322

(22) Filed: Mar. 13, 2019

Related U.S. Application Data

(60) Provisional application No. 62/642,116, filed on Mar. 13, 2018.

(51) Int. Cl.
*E04H 17/26* (2006.01)
*B66F 15/00* (2006.01)

(52) U.S. Cl.
CPC ..... *E04H 17/265* (2013.01); *B66F 15/00* (2013.01)

(58) Field of Classification Search
CPC ..... E04H 17/265; B66F 15/00
See application file for complete search history.

(56) References Cited

U.S. PATENT DOCUMENTS 3,674,239 A * 7/1972 Wirtgen ..... E04H 12/34 254/2 R
5,100,104 A * 3/1992 Wagner ..... E04H 17/265 254/123
5,490,757 A * 2/1996 Stratman ..... B66F 15/00 254/131
5,628,610 A * 5/1997 Stratman ..... B66F 15/00 254/131

* cited by examiner

*Primary Examiner* — Gerald McClain
(74) *Attorney, Agent, or Firm* — Richard Eldredge

(57) ABSTRACT

A stake pulling apparatus includes a base having a vertical support extending therefrom; a lever pivotally engaged with the vertical support at a first end of the lever; a head integrally connected to the lever at the first end; a mouth extending from the head and to open and close around a stake; and a handle engaged with the mouth to open and close the mouth; the lever provides a means to apply torque force to a stake engaged with the mouth to remove the stake from the ground.

3 Claims, 6 Drawing Sheets

STAKE PULLING APPARATUS AND METHOD OF USE

BACKGROUND

1. Field of the Invention

The present invention relates generally to stake pulling systems particularly with use of forming cement pours, and more specifically, to an apparatus for manually pulling stakes quickly and effectively without undue strain.

2. Description of Related Art

Using a plurality of stakes to aid in the formation of cement pours is well known in the art. For example, FIG. 1 depicts a conventional stake inserting system 101 having a hammer 103 being used to pound 105 a stake 107 into the ground 109. After the cement has been poured, the stake is typically removed by the user taking the hammer and hitting the stake from side to side to loosen it. During this process, the stake may break and become more difficult to remove. Further, this process is time consuming and labor intensive.

Accordingly, although great strides have been made in the area of stake pulling systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
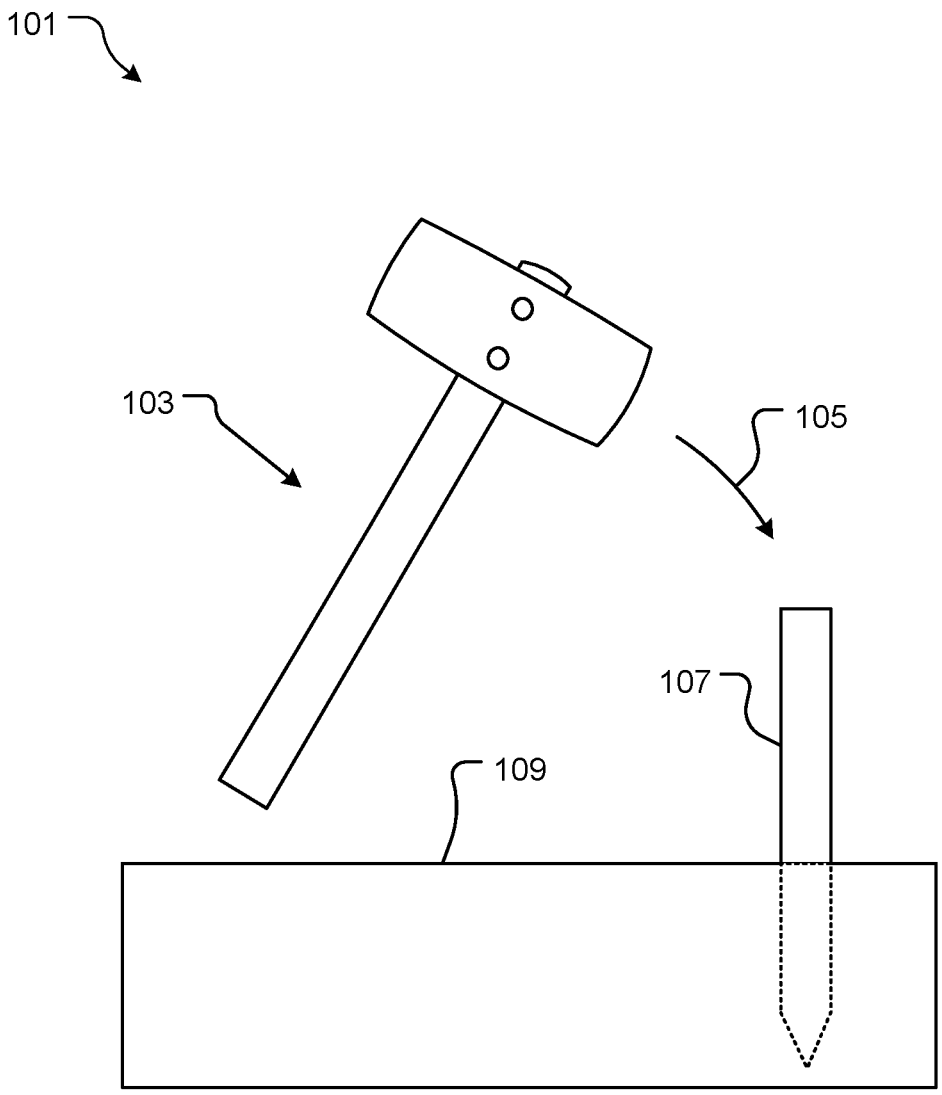
FIG. 1 (Prior Art)
FIG. 1 is a simplified front view of a common stake inserting system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional stake pulling systems. Specifically, the present invention provides an apparatus to manually remove stakes in an effective way while reducing labor associated with the task. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
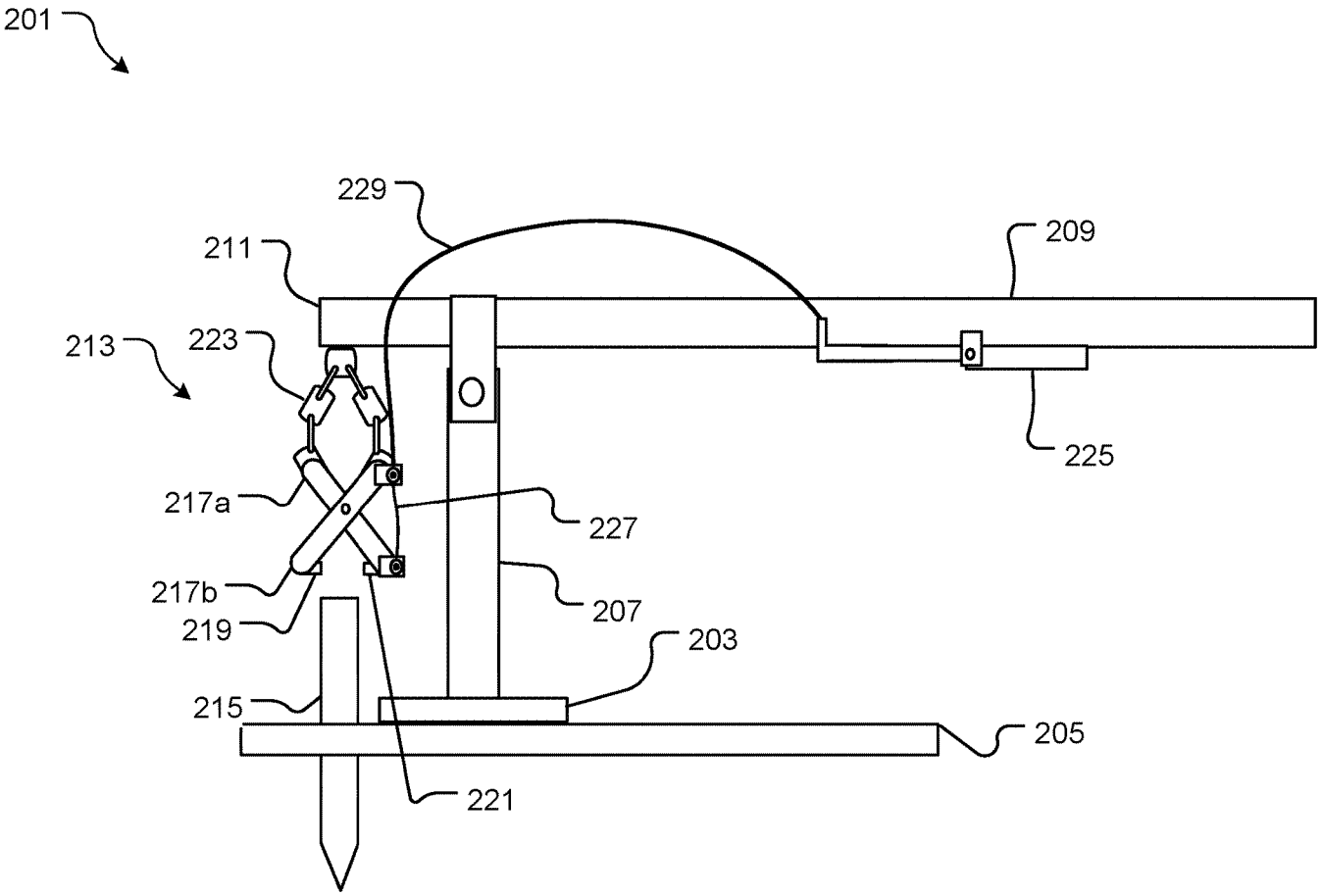
FIGS. 2A-2C are side views of a stake pulling apparatus in accordance with a preferred embodiment of the present application in various stages of use.
Figure 2B:
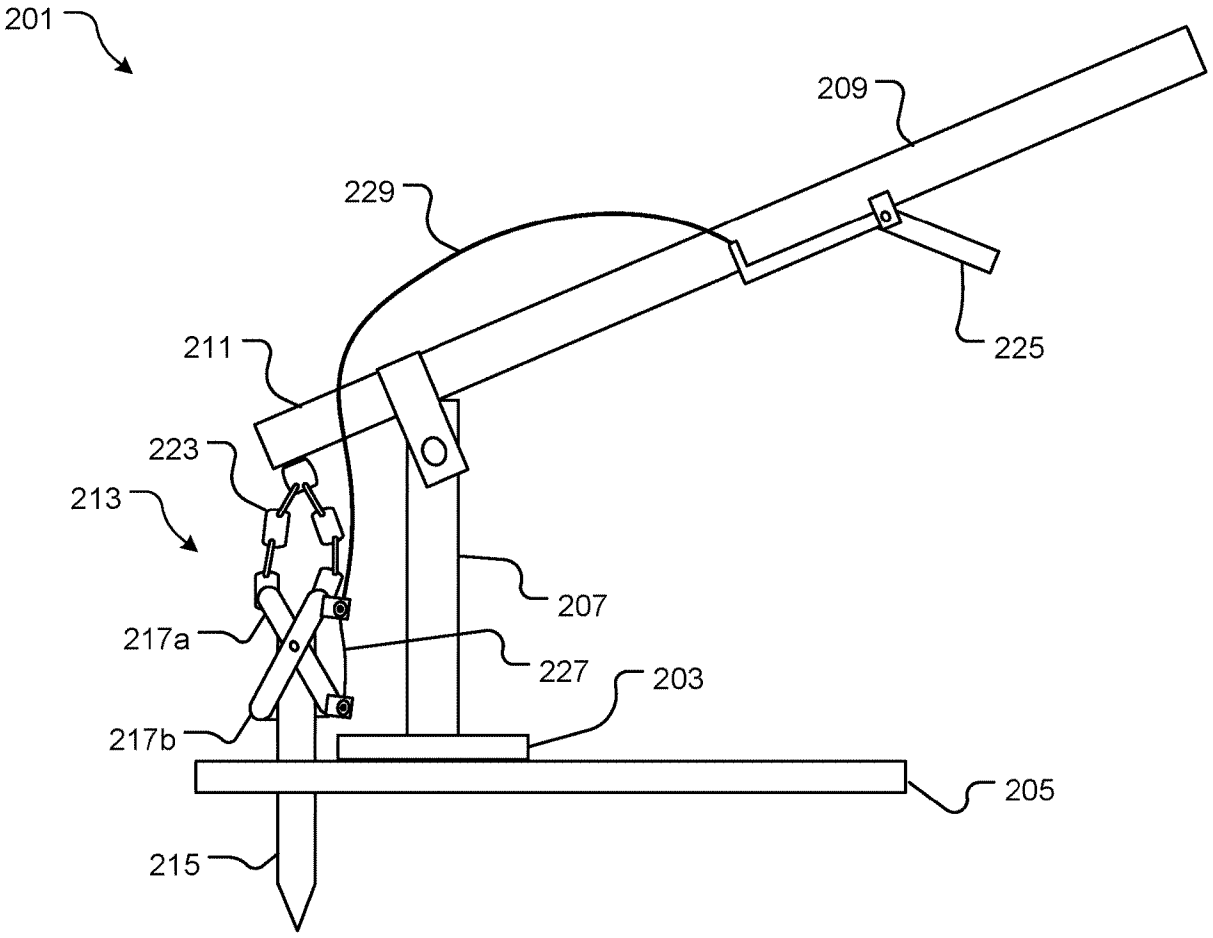
Figure 2C:
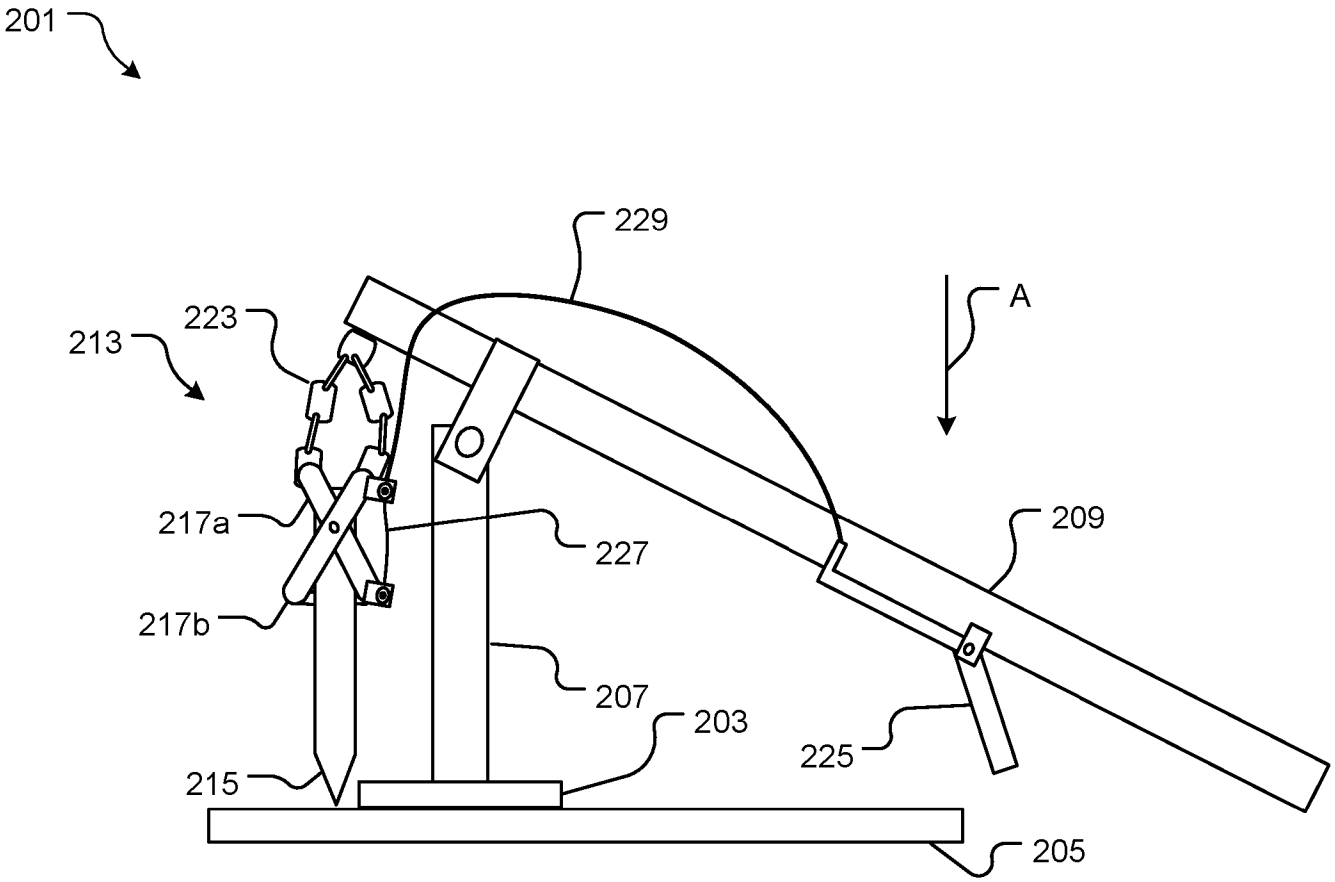

Referring now to the drawings wherein like reference characters identify corresponding or similar elements throughout the several views, FIGS. 2A-2C depict side views of a stake pulling apparatus 201 in accordance with a preferred embodiment of the present application. It will be appreciated that apparatus 201 overcomes one or more of the above-listed problems commonly associated with conventional stake pulling systems.

In the contemplated embodiment, apparatus 201 includes a base 203 configured to rest on a ground surface 205 and a vertical support 207 extending from base 203 to a lever 209, wherein lever 209 is pivotally engaged with vertical support 207. It should be appreciated that the size and materials of the various features can vary as desired for aesthetical, functional, or manufacturing considerations.

In the preferred embodiment, lever 209 is integrally attached to a head 211 at a first end of lever 209 and a mouth 213 is extended from the head 211, the mouth 213 being configured to engage with a stake 215 for removal. In the preferred embodiment, the mouth 213 includes a first pair of cross bars 217*a-b* and a second pair of crossbars (not shown due to the angle of FIGS. 2A-2C), wherein the first and second pairs of crossbars are attached via first and second horizontal bars 219, 221. IT should be understood that the crossbars are engaged via pivot points, thereby allowing for the mouth to open and close, thereby bringing the horizontal bars together and apart around the stake 215. The mouth 213 is suspended from head 211 via a flexible device 223, shown herein as chain but could be cable or the like.

In the preferred embodiment, the mouth 213 is operated via a handle 225 positioned along the lever, wherein the handle 225 is in communication with mouth 213. In the preferred embodiment, handle 225 operates a cable 227 via a cable housing 229 to operate the mouth 213 via spring loaded release. This allows for the user to open and close the mouth to receive the stake 215 therein.

As shown in FIG. 2B, the user tilts the lever 209 toward the stake 215, wherein the mouth 213 drops over the stake 215. When the user releases handle 225, the mouth 213 closes, thereby securing to the stake. As shown in FIG. 2C, when the user applies pressure, as shown with arrow A, to the lever, torque force is applied to the stake 215 via the mouth 213 to lift stake 215 from the ground 205.

It should be appreciated that one of the unique features believed characteristic of the present application is the mouth 213, wherein the mouth can be opened and closed easily via the handle to receive a stake securely. It should be appreciated that this feature provides for an efficient and effective means to remove a stake from the ground.

Figure 3:
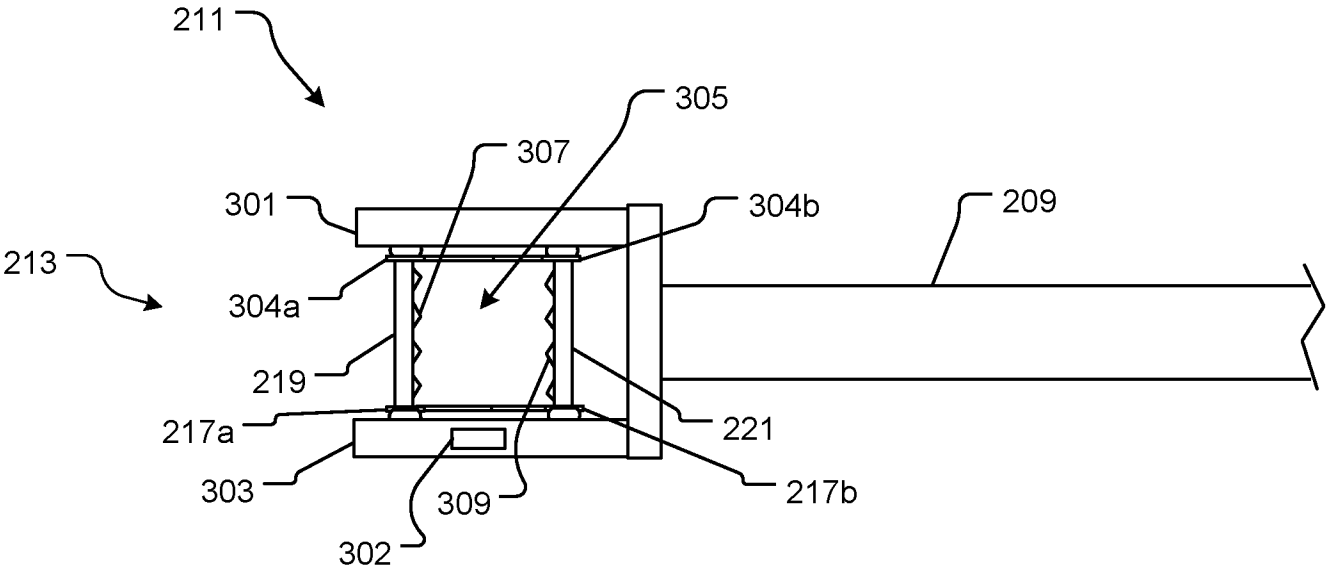
FIG. 3 is a top view of the head of the apparatus of FIGS. 2A-2C.

In FIG. 3, a top view of head 211 is shown for further clarity. Head 211 can include a first and second extension 301, 303 from which the mouth 213 is suspended. One or more openings 302 can be incorporated therein for guidance of the cable and cable guide. As shown, the horizontal bars 219, 221 extend from the first pair 217*a-b* of cross bars to the second pair 304*a-b* of cross bars, thereby forming an opening 305 through which the stake is received. As shown, the horizontal bars 219, 221 can optionally include teeth 307, 309 for additional grip.

Figure 4:
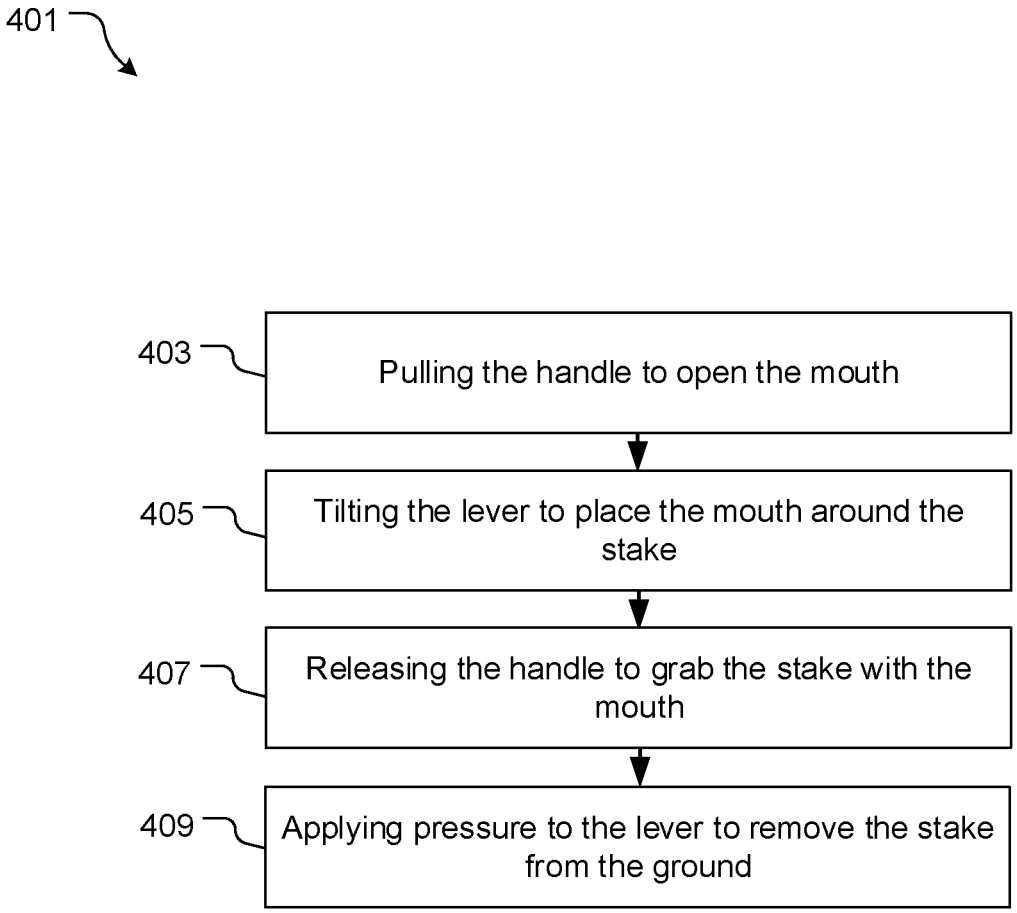
FIG. 4 is a flowchart of a method of use of the apparatus of FIG. 2.

In FIG. 4, a flowchart 401 depicts a method of use of apparatus 201. During use, the user pulls the handle to open the mouth, as shown with box 403. As the user tilts the lever, the mouth is placed around a stake, as shown with box 405. The user then releases the handle, wherein the mouth closes around the stake, as shown with box 407. The user can then easily apply force to the lever to remove the stake from the ground, as shown with box 409.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A stake pulling apparatus, comprising:

a base having a vertical support extending therefrom;

a lever pivotally engaged with the vertical support at a first end of the lever;

a head integrally connected to the lever at the first end;

a mouth extending from the head, configured to open and close around a stake, comprising:

a first side having a first pair of cross bars pivotally engaged;

a second side having a second pair of cross bars pivotally engaged; and two horizontal bars extending between the first pair and the second pair;

and a handle engaged with the mouth and configured to open and close the mouth;

wherein the lever provides a means to apply torque force to the stake engaged with the mouth to remove the stake from the ground;

wherein the two horizontal bars receive the stake therein; and wherein the handle is engaged with the mouth via a spring loaded cable.

2. The apparatus of claim 1, wherein the two horizontal bars include teeth protruding therefrom.

3. A method of removing a stake from the ground, the method comprising:

providing the apparatus of claim 1;

opening the mouth via the handle;

closing the mouth around the stake via releasing the handle; and applying force to the lever;

wherein the force to the lever creates torque force to raise the stake from the ground.

* * * * *